United States Patent [19]

Ploussios

[11] Patent Number: 4,631,544

[45] Date of Patent: Dec. 23, 1986

[54] S-BAND COAXIAL SLOT ARRAY ANTENNA

[75] Inventor: George Ploussios, Andover, Mass.

[73] Assignee: Tideland Signal Corporation, Houston, Tex.

[21] Appl. No.: 722,097

[22] Filed: Apr. 10, 1985

[51] Int. Cl.[4] ..... H01Q 13/10

[52] U.S. Cl. ..... 343/771

[58] Field of Search ..... 343/767, 768, 770, 771, 343/884

[56] References Cited

U.S. PATENT DOCUMENTS 2,744,249 5/1956 Shively et al. ..... 343/770

3,605,099 9/1971 Griffith ..... 343/771

*Primary Examiner*—Eli Lieberman

*Attorney, Agent, or Firm*—Fulbright & Jaworski

[57] ABSTRACT

An S-band antenna with a body having an inner circular tube and a coaxial outer circular tube in which the circumference of the outer tube is one wave length of S-band radar. A plurality of pairs of axially elongated slots are provided in the outer tube in which the slots of each pair are diametrically opposed to each other. Adjacent pairs of slots are axially displaced from each other a distance of one-half wave length. The pairs of slots are rotationally offset at an angle equal to 360/N where N is the number of pairs. A dielectric cover is provided around the outer tube.

4 Claims, 6 Drawing Figures

S-BAND COAXIAL SLOT ARRAY ANTENNA

BACKGROUND OF THE INVENTION

Radar is one of the most important electronic aids available for ships for improved safety of navigation. A radar display reflects objects within the radar service area which may represent either hazards to navigation or guidance devices. However, it is not possible to determine the identity of most reflecting objects from their radar traces alone. A marine radar beacon (RACON) provides a coded trace on a radar screen which can be readily identified as a particular racon. A racon is a microwave transmitter which is triggered to a response by a sending radar pulse from a ship resulting in a reply signal which locates and identifies the racon. The racon return signal must be synchronous with, and be frequency compatible with the radar receiver.

The present invention is directed to a horizonally polarized S-band antenna that is omni directional in the azimutal plane and having maximum directivity (gain) in the elevational plane. The present invention provides the smallest S-band antenna presently available with the lowest standing wave ratio, flatest azimutal gain, and the greatest gain of any presently known racon S-band antenna.

SUMMARY

The present invention is directed to an S-band coaxial antenna which has a body having an inner circular tube and a coaxial outer circular tube in which the circumference of the outer tube is equal to one wave length of S-band radar. A plurality of pairs of axially elongated slots are provided in the outer tube in which the slots of each pair are diametrically opposed to each other. Adjacent pairs of slots are axially displaced from each other of a distance of one-half wave length. The pairs of slots are rotationally offset at an angle equal to 360/N, where N is the number of pairs. The pairs of slots achieve omni directional coverage. A dielectric cover is provided around the outer tube for matching the impedance of the slots to a transmission line.

Still a further object of the present invention is wherein there are five pairs of axially elongated slots.

Still a further object of the present invention is wherein the length of the slots are slightly larger than one-half wave length long.

Yet a further object is wherein a driving pin is connected between the inner tube and the outer tube adjacent each slot.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
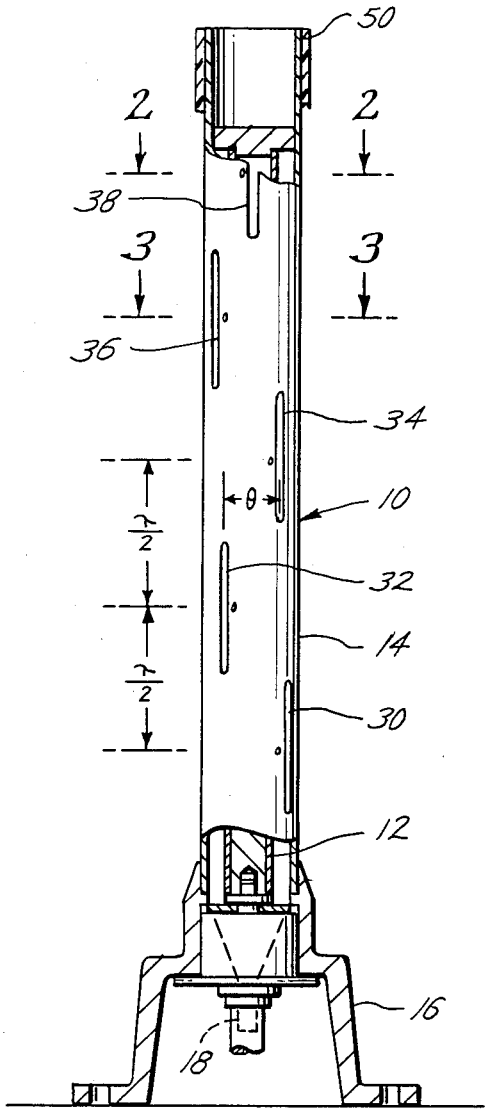
FIG. 1 is an elevational view, partly in cross section, of the apparatus of the present invention.

Referring now to the drawings, particularly to FIG. 1, the reference numeral 10 generally indicates the S-band coaxial slot array antenna of the present invention and generally includes a body having an inner circular coaxial tube 12 and a coaxial outer circular tube 14 mounted on a base 16 and having a connector 18 for a transmission cable.

The present antenna 10 provides a compact size antenna with a radiation pattern that is omni directional in the azimutal plane and having maximum directivity (gain) in the elevational plane.

Figure 4:
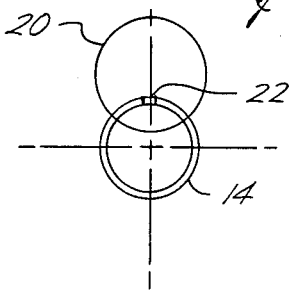
FIG. 4 is the directional pattern of a signal emitted from a single longitudinally slot.
Figure 5:
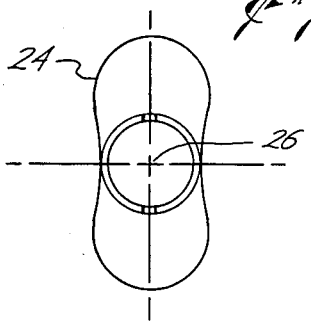
FIG. 5 is the directional pattern of a signal emitted from two equally weighted and phased slots diametrically opposed to each other.

Referring now to FIG. 4, a single longitudinal slot provides a directional pattern 20 about the slot position 22. However, as shown in FIG. 5, if the outer member 14 has two equally weighted and phased slots diametrically opposed to each other, the pattern generated is indicated by the graph 24 about the center axis 26 of the antenna 10. The details of the pattern shape are dependent upon the diameter of the tube 14 in wave lengths. The slot feed can be based upon coupling to a coaxial transmission line fields or by direct connection to the inner and outer conductor tubes 12 and 14. The latter approach represents the preferred approach due to its relative insensitivity to mechanical tolerances.

Figure 3:
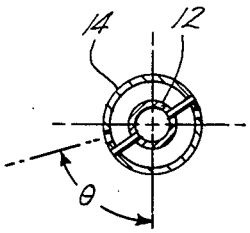
FIG. 3 is a cross-sectional view taken along the line 3—3 of FIG. 1.
Figure 2:
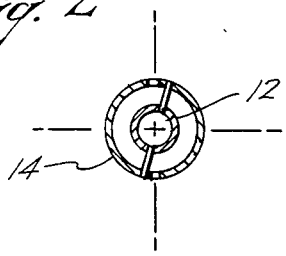
FIG. 2 is a cross-sectional view taken along the line 2—2 of FIG. 1.
Figure 6:
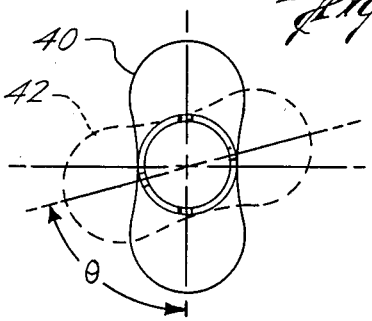
FIG. 6 is the directional pattern of a signal emitted from two different pairs of equally weighted and phased slots in which one pair is rotated relative to the other pair.

The present invention is directed to providing a plurality of pairs of axially elongated slots in the outer tube 14 with the slots of each pair being diametrically opposed to each other. Therefore, a plurality of slot pairs, preferably five slot pairs 30 and 30*a*, 32 and 32*a*, 34 and 34*a*, 36 and 36*a*, and 38 and 38*a*, may be provided. However, as illustrated in FIGS. 2 and 3 in order to properly feed the slots the path length around the circumference of the outer tube 14 must be a half wave length between the slots of each pair. That is, the outer circumference of the conductor tube 14 is one wave length of the S-band radar which is ten centimeters. This now defines the coaxial size of the antenna 10 and in the case of the S-band antenna the dual slot pairs results in the best physical size for the coaxial line and is selected as the basic element to be arrayed in the vertical plane. Each pair of slots provides a slot pattern in the dumb bell shaped element pattern 24 illustrated in FIG. 5 with the depth of the pattern depression relative to the pattern peak being about minus 7 db. However, in order to achieve omni directional coverage when arraying the slot pairs each slot pair is rotationally oriented at a different angle according to the equation:

$$\theta = 360/N$$

where N represents the number of vertically arrayed elements which in the preferred case is five pairs of slots. Referring now to FIG. 6, it is noted that the slot pattern 40 for one pair of slots is rotationally offset from the slots pattern 42 for a second pair of slots. It has been found that five pairs of slots which are offset at a rotationally angle of 72 degrees, according to the above equation, provide an omni directionally pattern within plus or minus 0.5 db.

The vertical arraying of the pairs of slots is achieved by spacing the slots one-half wave length apart along the circumference of the outer tube 14 while feeding the slot pairs in phase reversal relative to the adjacent pair of slots in order to achieve equal element phase. It is also noted from FIGS. 2 and 3 that a driving pin 42 is connected between the inner tube 12 and the outer tube 14 adjacent each of the slots. Thus, when the transmission waves extend up the annulus between the conductor tubes 12 and 14, the driving pins 42 excite the outer tube. Preferably, the length of the elongated slots 32, 32*a*, 34, 34*a*, 36, 36*a*, 38, 38*a* are slightly larger than one-half wave length long.

The individual slots are resonant elements whose impedance is real. The input impedance of the array of slots is determined by the combination of the individual slot pair impedance. Since the slot pairs are axially positioned at one-half wave length spacing the circuit effect is that of five equal impedances in parallel, where each impedance is the impedance of each slot pair. This combination impedance of the slot pairs is matched to the transmission line for maximum power conversion. In order to obtain a desirable impedance level for matching purposes the outer conductor tube 14 is provided with a dielectric cover 50. Further matching may be provided by a transformer section in the coaxial line.

In the preferred embodiment five slot pairs are shown, but any number of pairs can be provided such as two pairs or more. In the preferred embodiment the conductor tubes 12 and 14 are of aluminum and the dielectric 50 is fiberglass. For purpose of illustration only, the length of the outer conductor 14 is 11.79 inches. The pairs of slots are spaced axially one-half wave length or 1.962 inches center to center, and each elongated slot may be 2.300 inches with a width of 0.125 inches. The outside diameter of the outer conductor 14 is 1.25 inches.

An antenna made to the above specification had measured parameters as follows: A beam width of 18 to 21 degrees, a gain of 7.5 db, a circularity of plus or minus 0.5 db typical and plus or minus 1 db in the worst case, and a voltage standing wave ratio of 1.75 to 1 over the S-band frequencies.

The present S-band antenna is the smallest that is available and has the lowest standing wave ratio, flatest azimutal gain and highest gain than any other known racon S-band antenna.

The present invention, therefore is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within th spirit of the invention and the scope of the appended claims.

What is claimed is:

1. An S-band coaxial antenna comprising, a body having an inner circular tube and a coaxial outer circular tube, the circumference of the outer tube being equal one wave length of S-band radar, a plurality of pairs of axial elongated slots in the outer tube, the slots of each pair being diametrically opposed to each other, said adjacent pair of slots being axially displaced from each other a distance of one-half wave length, said pairs of slots being rotational offset at an angle equal to 360 divided by N, where N is the number of pairs, and a dielectric cover around the outer tube.

2. The apparatus of claim 1 wherein there are five pairs of axial elongated slots.

3. The apparatus of claim 1 wherein the length of the slots are slightly larger than one-half wave length long.

4. The apparatus of claim 1 including, a driving pin connected between the inner tube and the outer tube adjacent to each slot.

* * * * *